US005927524A

United States Patent [19]

Miller

[11] Patent Number: 5,927,524

[45] Date of Patent: Jul. 27, 1999

[54] BOTTLE SAFETY BLANKET

[76] Inventor: Rose M. Miller, 1967 Versailles Rd., Chula Vista, Calif. 91913

[21] Appl. No.: 09/060,127

[22] Filed: Apr. 14, 1998

[51] Int. Cl.[6] ..... A61J 9/08

[52] U.S. Cl. ..... 215/11.6; 215/365; 220/903; 206/459.5; 4/310

[58] Field of Search ..... 215/11.6, 11.1, 215/365, 392; 220/903; 206/459.1, 459.5; 40/5, 310, 900

[56] References Cited

U.S. PATENT DOCUMENTS

| | | | |
|---|---|---|---|
| 5,163,608 | 11/1992 | Block | 220/903 X |
| 5,188,877 | 2/1993 | Magaro | 220/903 X |
| 5,704,144 | 1/1998 | Groth | 40/306 |

*Primary Examiner*—Gary E. Elkins
*Assistant Examiner*—Tri M. Mai
*Attorney, Agent, or Firm*—Frank D. Gilliam

[57] ABSTRACT

A safety blanket for a baby bottle formed from two very thin flat layers of a liquid impervious material. The two layers of material are sealed around the periphery with the central body portion not attached so as to form a dead air space therebetween. The two layers are in the general shape of a rectangle with the shorter surface sufficiently sized to reach from top bottom of the bottle height. The longer dimension sufficient to surround the circumference of the bottle reservoir. A fastening method for attaching the safety blanket around the bottle is provided as is an envelope associated with the fastening method for inserting a substrate with indica thereon.

5 Claims, 2 Drawing Sheets

BOTTLE SAFETY BLANKET

FIELD OF THE INVENTION

The invention is directed to preventing the transfer of any extreme temperatures above or below ambient temperature to the small hands of a baby holding a baby bottle.

BACKGROUND OF THE INVENTION

U.S. Pat. No. 1,464,525 by inventor S. F. Girr teaches a combination rag doll nursing bottle cover, protector and heat preserver. The cover includes a very pliable, plicated envelope with a removable thick padding preferably rubber sponge therebetween. The cover completely encloses the nursing bottle. The envelope can be washed either complete or dissembled.

U.S. Pat. No. 1,669,061 by inventor I. Meltzer teaches a combined heat insulator and protector for a milk bottle or the like. The device is a padded bag like structure with a small opening for passing binding tape therethrough for securing the cover to the bottle. The insulating material is not removable from between but rather is attached thereto the inner and outer cover. The cover is formed from a plurality of per cut and shaped flat material.

U.S. Pat. No. 2,711,052 by inventor G. J. Brayford teaches a combined doll and nursing bottle holder. The holder is constructed of material such as sponge rubber or a synthetic resin.

U.S. Pat. No. 4,282,279 by inventor Robert D. Streckland teaches an insulating cover for a bottle having an insulating layer positioned between a pair of spaced apart layers. The cover is formed from flat material and is wrapped around a bottle and secured with a combination of Velcro type fasteners and a drawstring about the top. The top and bottom are both open.

U.S. Pat. No. 5,109,588 by inventor Kenneth M. Hewlett et al., U.S. Pat. No. 5,318,821 by inventor James B. Bradley, Jr. and British patent no. 589,203 by inventor Paul Emil Allen teach insulator wraps not unlike the teaching of U.S. Pat. No. 4,282,279 immediately discussed above.

There is an ever present need to further provide improved products to provide save and injury preventive products for babies.

SUMMARY OF THE INVENTION

A safety blanket for a baby bottle having an open top and closed bottom surface constructed with thin outer layers of a liquid impervious material such as for example Rip Stop Nylon or the like that is serviceable, can be readily cleaned after use and isolates the outer surface from the temperature of the contents of a baby bottle on which it is normally used. The safety blanket is formed from two surface layers having a generally rectangular form and bound together only around the periphery with a liquid impervious binding tape sewed as shown or sealed together by any other convenient method thereby preventing the inner open space, pocket or captive air space between the layers from being exposed to liquid from the outside.

Velcro hook and eye fasteners are fixedly attached to the same outer surface of the safety blanket. Two spaced apart first fastening portions in the form of a tab, either hook or eye with hook portion preferred, extend beyond one of the narrow edges of the material forming the safety blanket. On the opposite narrow edge two second spaced apart mating fastener portions either hook or eye preferably the eye portion are fixedly attached to the outer surface as the first fastening portions. When wrapped around a baby bottle, the first and second fastener portions mate and lock together maintaining the safety blanket about the baby bottle.

On the exposed surface of the first fastening portions when the safety blanket is mated on the baby bottle is an envelope formed by a layer of transparent material attached to the exposed surface of the first fastening tab portions. A substrate formed of a rigid material with selected indica thereon can be inserted within the pocket of the envelope and the envelope end opening can be then sealed. The envelope opening at the outer surface can be sealed with an adhesive material that seals the open surfaces forced together. The adhesive material can either make a permanent or temporary closure of the opening. The use of temporary non-setting adhesive allows that the opening to be reopened as desired for changing the indica material therein and resealing.

The outer rectangular covers can have fancy child identifiable indica printed thereon.

An object of the present invention is to provide a selectively removable safety blanket for a baby bottle that allows the outer surface thereof when secured around a baby bottle to maintain an ambient temperature regardless of the temperature of the contents of the bottle.

Another object of the present invention is to provide a baby bottle safety blanket that is formed of only two thin layers of a liquid impervious material with a dead air insulating space therebetween.

A further object of this invention is to provide a baby bottle safety blanket that has the two layer of material sealed around the periphery thereof to prevent the entry of liquid between the layers.

Yet another object of the present invention is to provide a baby bottle safety blanket constructed of a material that can be continually used and washed while maintaining a dry inner surface dead air space therebetween.

These and other objects and features will become apparent when the specifications are read in view of the following drawing Figures.

BRIEF DESCRIPTION OF THE DRAWING FIGURES

DETAILED DESCRIPTION OF THE PREFERRED EMBODIMENT

Figure 1:
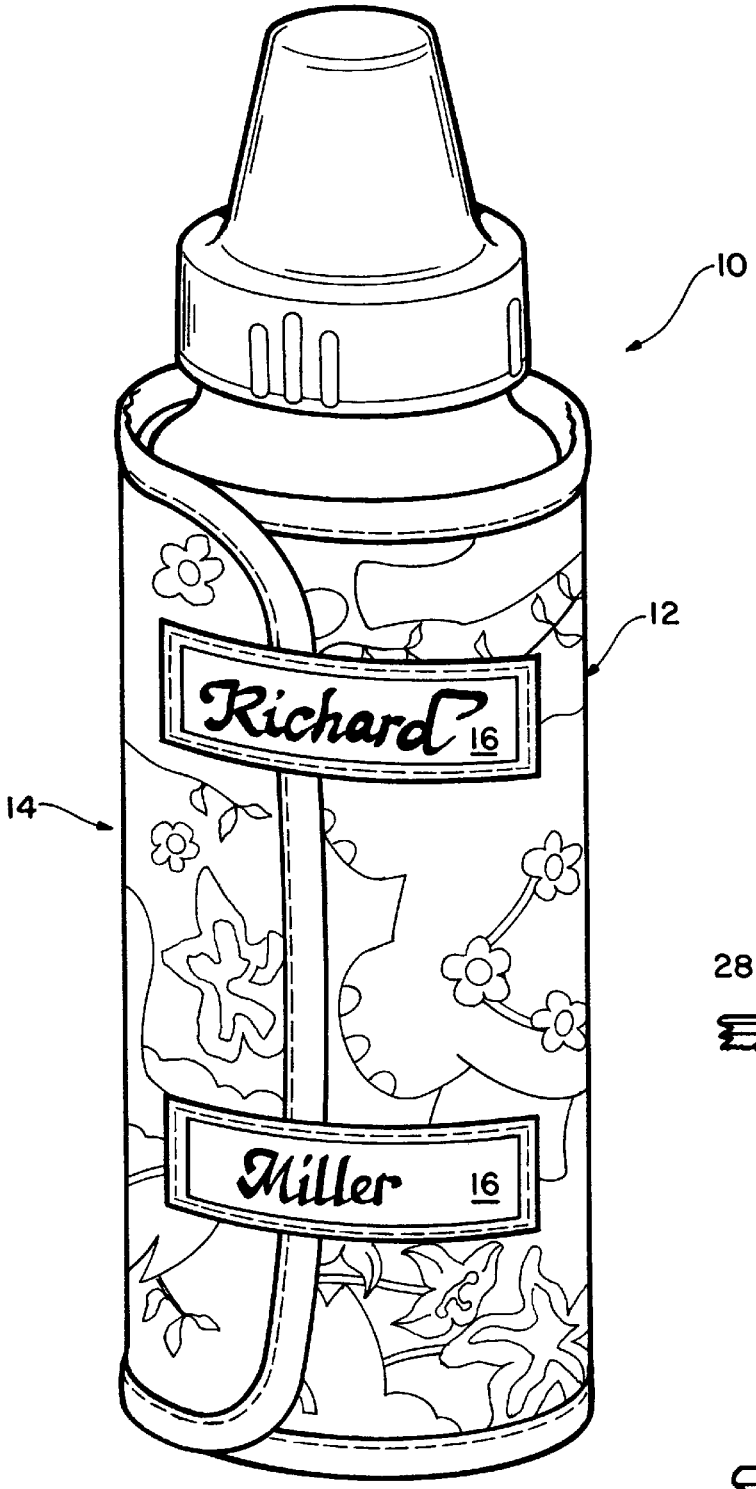
FIG. 1 is an elevated perspective showing of the bottle safety blanket of the invention installed on a baby bottle.
Figure 2:
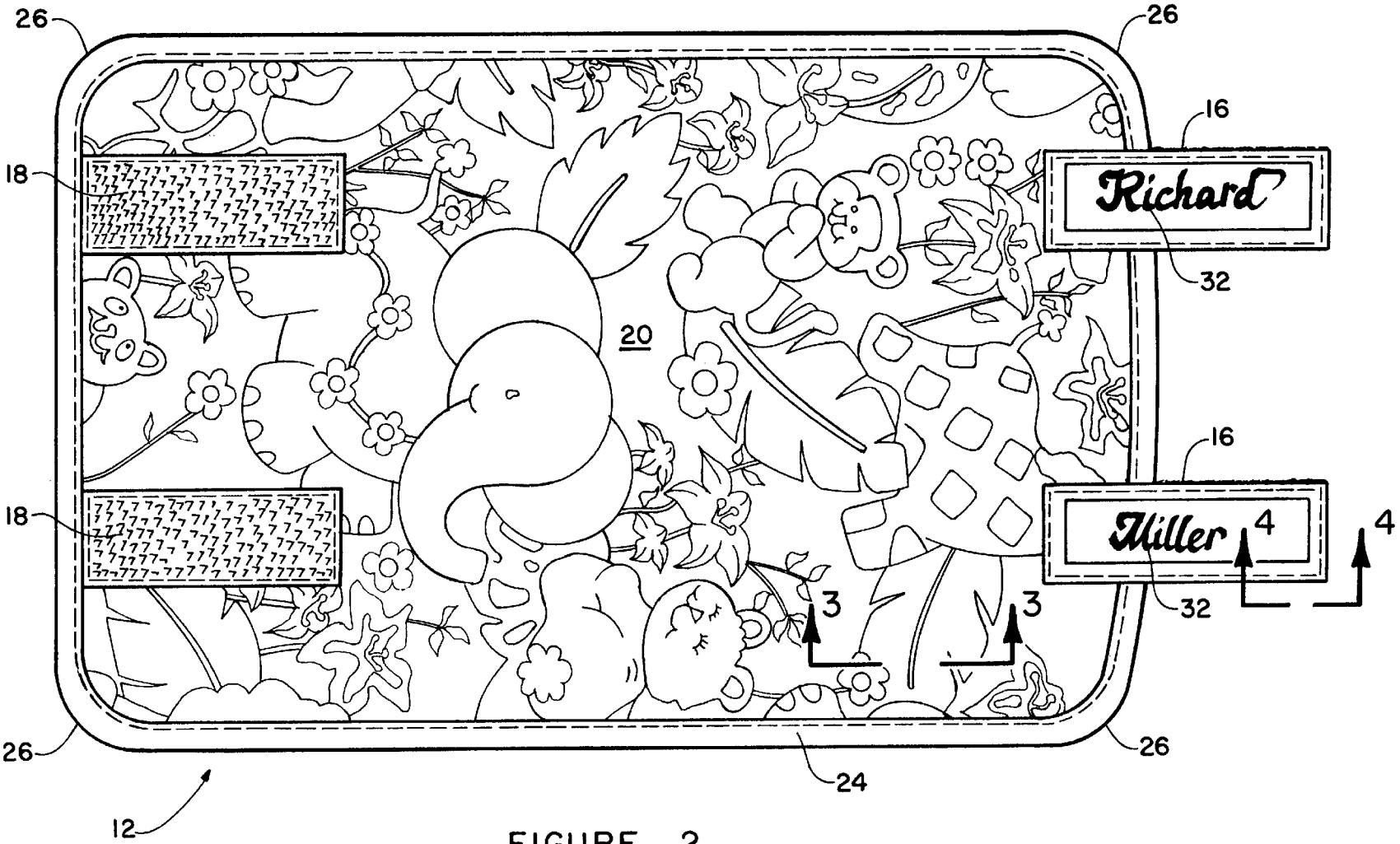
FIG. 2 is a plan view of the bottle safety blanket of the invention prior to wrapping about a bottle.

Referring now specifically to drawing FIG. 1 and 2, a baby bottle 10 is shown with the baby bottle safety blanket 12 of the invention attached. The safety blanket when installed on the baby bottle surrounds the complete circumstance of the reservoir portion 14 of the baby bottle and over laps so as to accommodate a plurality of bottles having different circumferences. The width can be varied also for baby bottles having different a reservoir capacities. First and second fasteners 16 and 18 for maintaining the safety blanket around the baby bottle are shown attached to the same surface 20 of the safety blanket 12. Details of the first and second fasteners are clearly shown in drawing FIG. 2.

The safety blanket is formed from two thin layers 20 of liquid impervious material such as plastic, Nylon or the like, both layers are identical as shown as 20. The principle requirement is that the material 20 be thin in nature that is suitable for the purpose intended. The main purpose being that the outer surface of the outer layer the two layers of thin material with the dead air space 22 therebetween, see drawing FIG. 3, maintain ambient temperature regardless of the temperature of liquid in the bottle reservoir and that the outside circumstance of the bottle with the safety blanket installed is not increased excessively so that it is hard for an infant grasping the combination bottle and safety blanket to hold the combination when in use. It should be understood that the dead air space 22 between the two layers of material does not exist in the areas grasped by the child thereby preventing excessive bulk to the combination safety blanket and bottle. The portion not grasped still provides some dead air space insulation.

Referring now specifically to drawing FIG. 2, the plan view of the bottle safety blanket 12 is generally of a rectangular configuration with the width determined for the height of the baby bottle to be enclosed and the length sufficient to enclose the liquid containing portion 14 when wrapped around the circumstance of the bottle when installed as shown in drawing FIG. 1.

The two thin layers of material 20 forming the safety blanket 12 are bound completely around the outer periphery with an liquid impervious binding material 24. The corners 26 are rounded only for the convenience of sewing which is one way the two thin sheets 20 can be attached together. It should be understood that the two thin sheets of material can be attached together around the periphery by any other convenient method, such as, an adhesive, melt bonding or the like.

On the surface shown as the outer surface of layer 20, attachment tabs 16 and mating attachment strips 18 are shown.

Referring now back to drawing FIG. 1, it can be seen that the tabs 16 extend beyond the end of the layer and overlap onto the same layer for connection with the mating attachment strips 18. The tabs and attachment strips are so placed on the outer surface of the material 20 so as to accommodate bottles with various different circumstances as fore mentioned.

Figure 3:
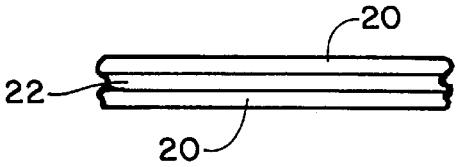
FIG. 3 is an enlarged showing of a section of the bottle safety blanket taken along line 3—3 of FIG. 2 with a dead air space exaggerated.

Drawing FIG. 3 depicts a section of the safety blanket taken along line 3—3 of FIG. 1 and depicts the two thin layers 20 forming the body of the safety blanket. The tabs 16 and strips 18 are fixedly attached to the same surface of the safety blanket as depicted in FIG. 2. The tabs and strips can be attached by stitching as shown, adhered to or any other convenient method.

The tabs are formed of the same or similar material as are the two thin layers forming the safety blanket. Each of the tabs have a transparent overlay sheet 28 forming a pocket 30 which allows indica 32 to be placed within the pocket between the upper surface of the tab 16 and the inner surface of the transparent overlay 28. The indica shown in represents the name of the child to which the bottle belongs. Any other indica can be placed in the formed pocket.

Figure 4:
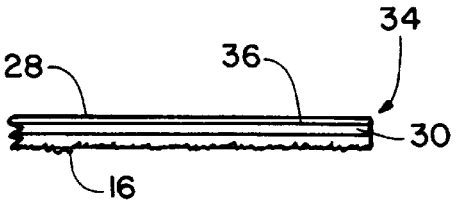
FIG. 4 is a showing taken along line 4—4 of FIG. 2.

Referring now to drawing FIG. 4 positioned at the open tip 34 of the pocket is an adhesive 36 that seals the open surface of the pocket against the entrance of any liquid. The adhesive can be of the permanent setting type or that type of adhesive that at a latter time the reopening of the envelope for the insertion of a different indica therein and resealed. The substrate for the indicia can be any suitable material for maintaining the indica thereon either by printing or writing.

As is seen in drawing FIG. 2 an indica theme appropriate for a child can be affixed to the outer surfaces of the safety blanket by any convenient means.

Therefore, it should be understood that the particular embodiments shown in the drawings and described within the specifications are for the purpose of example and should not be construed to limit the invention which will be described in the claims below. Now that a number of examples of the apparatus of the invention have been given, numerous other applications should be evident to one skilled in the art. Further, it is evident that those skilled in the art may now make numerous uses and modifications of the specific embodiments described herein. It should be obvious that the various members described may be made from a variety of materials and using a wide combination of dimensions. Consequently, the invention is to be construed as embracing each and every novel feature and novel combination of the features present in or possessed by the apparatus described herein.

What is claimed:

1. A safety blanket for a baby bottle having a reservoir for containing a hot or cold liquid that prevents the transfer of the temperature of said hot or cold liquid to the hands of a baby holding and feeding from said baby bottle comprising:

a generally rectangular cover having one dimension that is substantially the longest dimension of said reservoir and a second dimension sufficient in length to at least surround the outer surface of said reservoir;

said rectangular cover comprises two layers of very thin liquid impervious material, said layers being fixedly attached together around the entire periphery of said rectangular cover thereby providing a dead air space between the layers;

spaced apart fastening means fixedly attached to said side having said longest dimension;

fastening attachment means fixedly attached to the same side of said rectangular cover opposite to said spaced apart fastener means and positioned to securely mate therewith when engaged; and a transparent pocket forming means fixedly positioned on an exposed surface of said fastener means forming a transparent pocket for the removable insertion of indica within said pocket, for viewing said indica within said pocket, said indica means and said pocket being impervious to liquid.

2. The invention as defined in claim 1 wherein said two layers are formed from woven Nylon.

3. The invention as defined in claim 1 wherein said two layers are formed from a plastic sheet.

4. The invention as defined in claim 1 wherein fastening means extends beyond the surface to which it is attached.

5. The invention as defined in claim 4 wherein said fastening attachment means is secured to the same side of said two layers as said fastening means.

* * * * *